United States Patent [19]

Kahn

[11] 4,316,340

[45] Feb. 23, 1982

[54] SAFETY MECHANISM FOR FIREARMS

[75] Inventor: Harvey Kahn, Port Jefferson, N.Y.

[73] Assignee: Alan I. Gerald Corporation, North Haven, Conn.

[21] Appl. No.: 107,394

[22] Filed: Dec. 26, 1979

[51] Int. Cl.[3] ..... F41C 17/04

[52] U.S. Cl. ..... 42/66; 42/70 F

[58] Field of Search ..... 42/66, 70 F

[56] References Cited

U.S. PATENT DOCUMENTS 3,626,623 12/1971 Uberti ..... 42/66

3,777,384 12/1973 Ruger et al. ..... 42/66

*Primary Examiner*—Charles T. Jordan

*Attorney, Agent, or Firm*—Berger & Palmer

[57] ABSTRACT

An improved safety mechanism for a firearm of either the single or double action type is disclosed in which a slot or hollow is formed in the hammer behind the firing pin. The hollow houses a freely pivotably mounted anvil safety, which in the safe position of the gun is incapable of exerting a force upon the firing pin. An anvil connector bar is upwardly moved under control of the trigger to positively urge the anvil safety to form a firm impact surface against the firing pin, by eliminating the free pivotal movement of the anvil safety.

11 Claims, 6 Drawing Figures

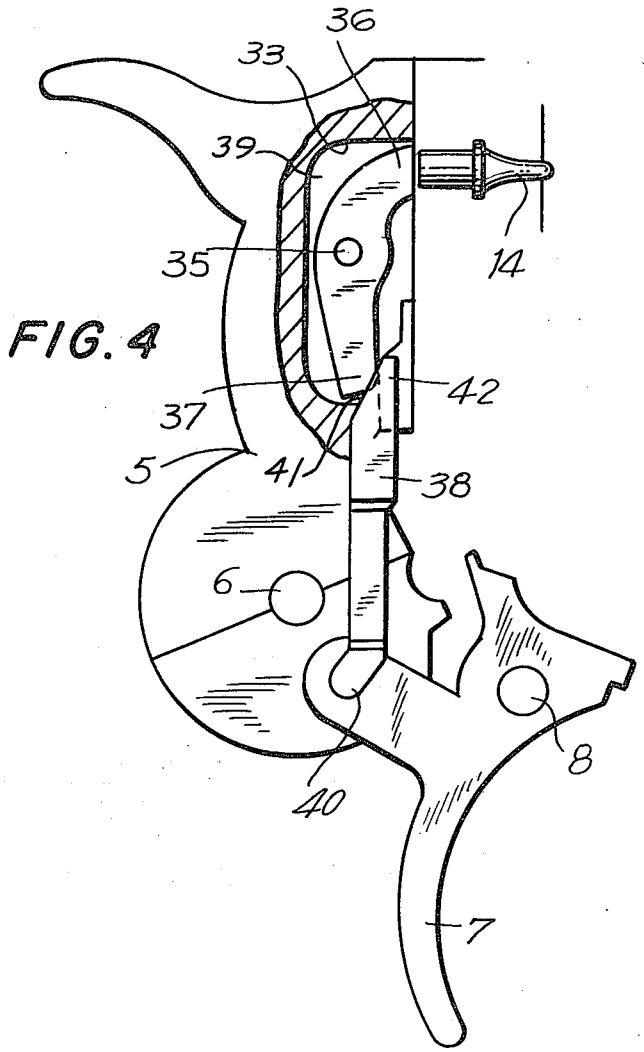
FIG. 4
FIG. 2
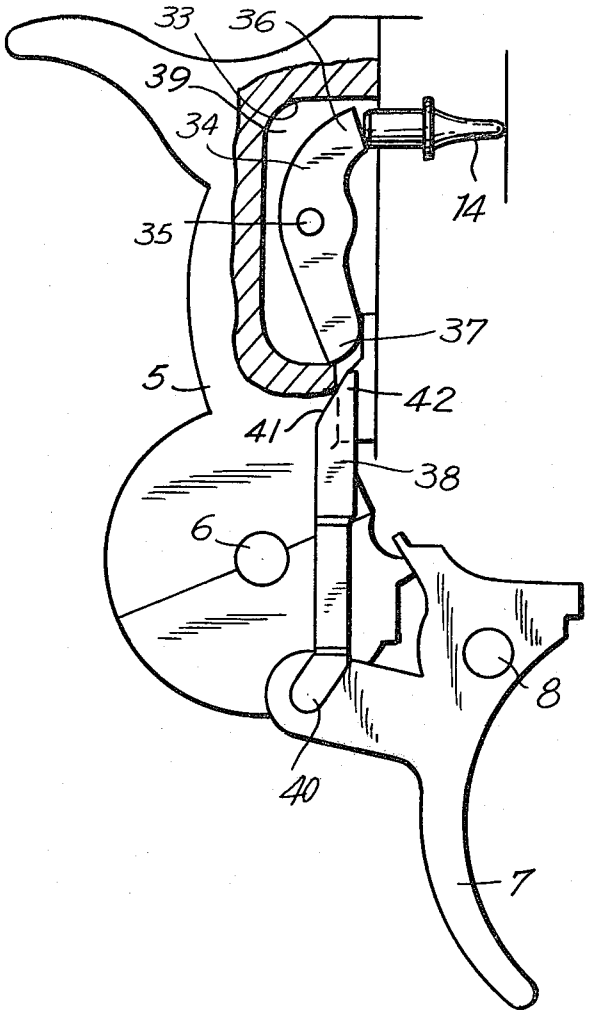

SAFETY MECHANISM FOR FIREARMS

BACKGROUND OF THE INVENTION

This invention relates to revolvers and other firearms having an external hammer, and in particular to improved safety mechanisms for such firearms.

Firearms of the type to which the present invention relates are those firearms having an external hammer. Such firearms include single and double action revolvers, single shot rifles and shotguns of the breakopen type having an external, manually cocked hammer, lever or pump action repeating rifles and shotguns having an external hammer that may be cocked manually or when the action is worked, and similar single action firearms. The hammer also has a safety notch that is engaged by the sear (or some equivalent element) of the trigger when the hammer is in its safe position out of contact with a cartridge received in the chamber of the firearm. Thus, the hammer may be placed in any one of at least three positions—namely, its firing position at which the hammer and firing pin rest against a cartridge received in the chamber of the firearm, its safety position at which the trigger engages the safety notch formed in the hammer, and its fully cocked position at which the trigger seat engages the sear notch of the hammer. In addition, in the case of a single action revolver the hammer is provided with a loading notch which, when engaged by the trigger, maintains the hammer in its loading position.

The cocked position does not exist in a double-action firearm, since the trigger moves the hammer from its safe position through the cocked position to the firing position in one continuous movement. In such firearms, the sear notch, utilized for singe-action firearms, is not included in the gun design.

The loaded firearm is normally carried with the hammer in its "safe" position at which the safety notch of the hammer is engaged by the trigger. However, the safety notch of the hammer is a point of mechanical weakness in the design of conventional single action firearms with consequent danger of accidental discharge of the firearm if the hammer or trigger are accidentally struck when in its presumed safe position. It is the purpose of the present invention to provide a new and accident proof safety and firing mechanism for single and double action firearms which eliminates the potentially dangerous safety notch of such conventional firearms.

An object of this invention is to provide an improved safety mechanism for single and double actions firearms, especially revolvers.

Another object of this invention is to provide such a safety mechanism which also increases the efficiency of the firearm fire action.

Yet another object of this invention is to provide such a safety mechanism which can be incorporated in conventional firearm designs, which enable such firearms to operate in their conventional fashion.

Another object of this invention is to provide such a safety mechanism which is easy to manufacture and assemble and is capable of reliable operation.

Other objects, advantages and features of this invention will become more apparent from the following.

SUMMARY OF THE INVENTION

The improved safety mechanism of the invention is applicable to firearms having an external pivotally mounted hammer, a trigger pivotally mounted below the hammer, a cylindrical member (for example, a rifle barrel or the rotatable cylinder of a revolver) mounted in front of the hammer and having at least one chamber that is adapted to receive a cartridge, and a firing pin associated with the hammer and mounted in position to strike a cartridge received in the chamber when the firearm is fired. The hammer can be cocked either by pulling the trigger (double action), or by manual cocking (single action).

In accordance with the invention, the above objects are met by providing a firearm having a movable hammer, a cartridge receiving chamber located in front of the hammer when the hammer is in a strike mode, a firing pin associated with the hammer and mounted in position to strike and fire a cartridge in the chamber, a trigger pivotally mounted below said hammer to control the hammer movement, a vertical slot formed in said hammer, said slot being located behind said firing pin to form a hollow behind said firing pin, a vertical anvil safety member located within said vertical slot and pivotally connected to said hammer about a horizontal axis, the upper portion of said anvil safety member being located behind said firing pin and forming the striking surface of the hammer, said anvil safety member being freely pivotable when the trigger is in its safety position such that said hollow and said anvil safety member prevent a firing force from being exerted on said firing pin, and an anvil connector bar pivotally connected to said trigger and having an upper portion adapted to be positioned to bear against the lower portion of said anvil safety member when said trigger moves toward its fire position, so as to move said anvil safety member to fill said hollow with a fixed impact surface which moves forward to fire and strike said firing pin.

BRIEF DESCRIPTION OF THE DRAWINGS

FIG. 2 is a fragmentary side view of the safety mechanism of this invention without the remainder of the revolver assembly with the hammer in a safe or initial position;

FIG. 4 is a fragmentary side view similar to FIGS. 2 and 3 showing the safety mechanism upon impact, that is, in the fire position;

DETAILED DESCRIPTION

Figure 1:
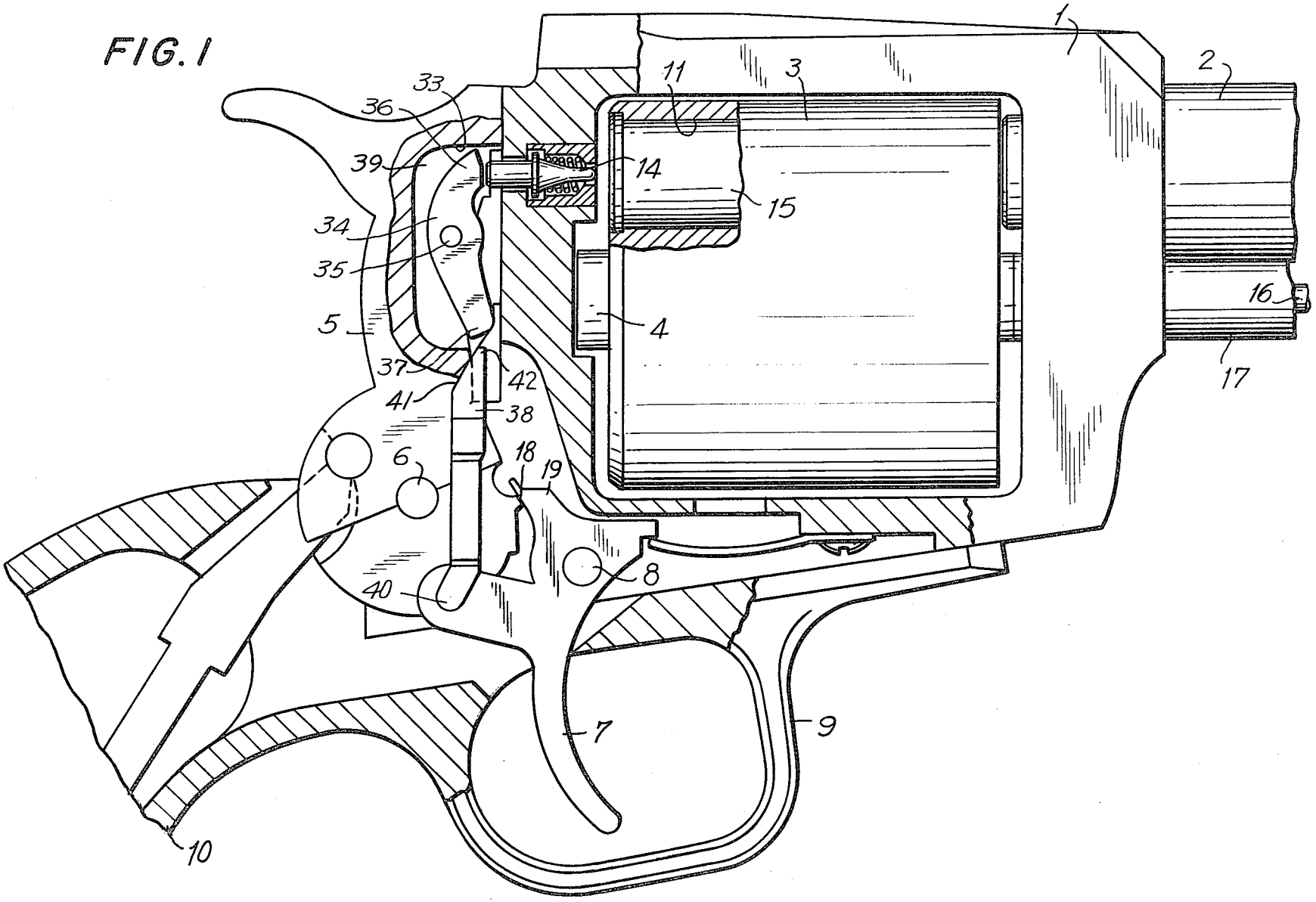
FIG. 1 is an enlarged right hand side elevation, partly broken away, of a single action firearm (specifically, a single action revolver) provided with an advantageous embodiment of the safety mechanism of the invention.

The improved mechanism of the present invention is illustrated in connection with a single action firearm, having an external hammer that must be cocked before the trigger can be pulled. As previously noted, such single action firearms include, but are not limited to, single action revolvers, single shot rifles and shotguns of the breakopen type having an external hammer, and lever or pump action repeating rifles and shotguns having an external hammer that may be cocked manually or when the action is worked. Additionally, the present invention may be used with all double action firearms such as revolvers, rifles and shotguns. However, in the interest of simplifying the description, the invention will be described in connection with a single action revolver of essentially conventional construction.

The major components of the single action revolver embodying the firing mechanism of the invention include a frame 1, a barrel 2 secured to the frame, a cylinder 3 rotatably mounted on the frame by means of the cylinder pivot shaft 4, a hammer 5 pivotally mounted on the frame by means of the hammer pivot pin 6, a trigger 7 pivotally mounted on the frame by means of a trigger pivot pin 8, a trigger guard 9, and hand grips 10. The cylinder 3 is formed with a plurality of cartridge receiving chambers 11, each chamber of the cylinder successively being held in alignment with the bore of the barrel 2. A firing pin 14 is mounted in position to strike a cartridge 15 contained in the uppermost chamber 11 of the cylinder 3 when the revolver is fired. An ejector rod 16 is provided for ejecting spent cartridges from the chambers of the cylinder 3, the ejector rod being contained in an ejector rod housing 17 mounted on one side of the barrel 2.

Referring now to the single action revolver, FIG. 1 shows the revolver with the hammer 5, the trigger 7 and the parts associated therewith in their rest or safe position. The hammer 5 is formed with a cam surface 18 that contacts the trigger arm 19 of the trigger 7 when the hammer is rotated from its rest position to its cocked position, thereby causing the trigger to rotate from its rest position to its ready-to-fire position. As the trigger 7 is rotated from its rest position to its ready-to-fire position, the cylinder is caused to rotate when the hammer 5 is rotated to its cocked position shown. When the hammer and trigger are in their ready-to-fire positions, and the trigger 7 is pulled the hammer 5 springs forwardly under the pressure of the hammer spring. Further reference to U.S. Pat. No. 3,777,384 for the conventional details of a single action revolver may be undertaken.

The hammer of a conventional single action revolver is formed with a safety notch that is engaged by the sear (or some equivalent element) of the trigger when the hammer is in its safe position.

The hammer 5 is further provided with a vertical slot 33 in which there is located an anvil safety member 34. Member 34 is a generally rearwardly bowed shaped element pivotally connected in the slot above its center by a retaining pin, so that the greater part of the mass of member 34 is below pin 35. This ensures that in the event the firearm is accidentally dropped on its barrel end, the force of gravity and inertia will prevent the upper part of member 34 from striking the firing pin. The upper portion 36 of the anvil safety member 34 is located in front of the firing pin 14, while the bottom portion 37 is adapted to cooperate with an anvil connector bar 38.

Referring to FIGS. 1 and 2, the improved safety mechanism of this invention is shown with the trigger in its safe position. The vertical slot 33 is so located with respect to firing pin 14 that a hollow 39 is formed behind the pin. In the safe position, the anvil safety member 34 is freely rotatable, so that no force can be exerted upon firing pin 14 since the upper portion 36 cannot transmit significant force against the firing pin.

The anvil connector bar 38 is pivotally connected at its lower extremity 40 to the rear portion of trigger 7 and terminates in an upwardly sloped surface 41 at its upper portion 42. Additionally, the top portion 42 is provided with a front pad 43 which rests against surface 48 formed in the frame of the revolver. The guide surface is vertical in orientation and permits the anvil connector bar to be moved vertically upward when the trigger is moved.

The upper portion 42 of anvil connector bar 38 terminates below the bottom portion 37 of the anvil safety. The anvil connector bar is free to move upwardly under the normal movement of trigger 7, and such movement is not blocked by the bottom 37 of anvil safety 34.

Figure 3:
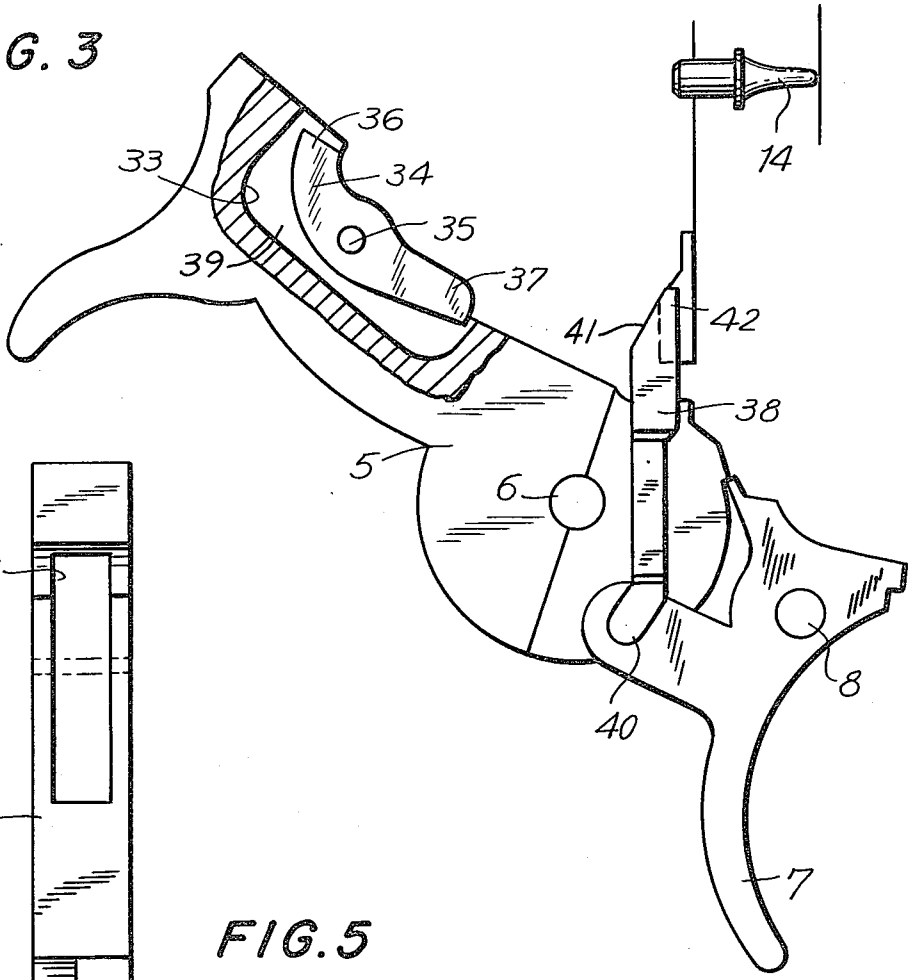
FIG. 3 is a fragmentary side view similar to FIG. 2 showing the safety mechanism in the cocked and ready-to-fire position.

Referring to FIG. 3, the gun is shown in the manually cocked position, with the hammer 5 being pulled back. In this position, the trigger 7 is also pulled rearwardly and the upper portion 42 of the anvil connector bar is moved vertically upward by means of the pivotal connection 40 between anvil connector bar 38 and trigger 7.

Referring to FIG. 4, the gun is shown in its fire position with the hammer 5 having moved forwardly. When the hammer moves forwardly, it carries the anvil safety 34, but the bottom 37 of anvil safety now impacts the upper portion 42 of anvil connector bar 38 which had been moved upwardly in the cocked and ready-to-fire position as illustrated in FIG. 3. Therefore, as the hammer moves forward, the bottom of the anvil safety impacts the upper portion of the anvil connector bar causing a forward thrust force to be transmitted through the anvil safety to its upper portion 36. The striking surface of the upper portion 36 of the anvil safety bears against firing pin 14 causing the pin to strike and fire a cartridge in the chamber, thus causing a bullet to be shot from the gun. As may be understood, when the gun is in the fire position, the anvil safety eliminates the hollow 39 formed in FIG. 2 by providing a rigid strike surface to carry the force of the impact between bottom portion 37 of the anvil safety and upper portion 42 of the anvil connector bar 38. This strike force is additional to that carried by the normal movement of the hammer forwardly, so that the firing action is further enhanced during the normal firing movement of the gun.

FIGS. 2, 3 and 4 are applicable to be used with a gun having either single action or double action characteristics, and such safety mechanism may be readily adapted for such firearms.

Figure 5:
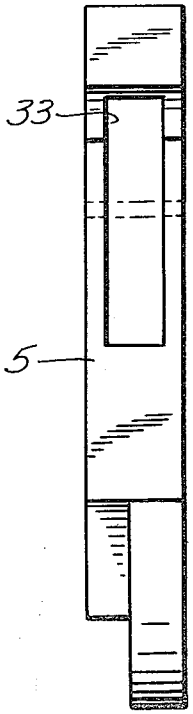
FIG. 5 is an end view of the hammer showing the slot in the hammer for the anvil safety member.

Referring to FIG. 5, there is shown an end view of the hammer showing the slot 33 in which the anvil safety member moves.

Figure 6:
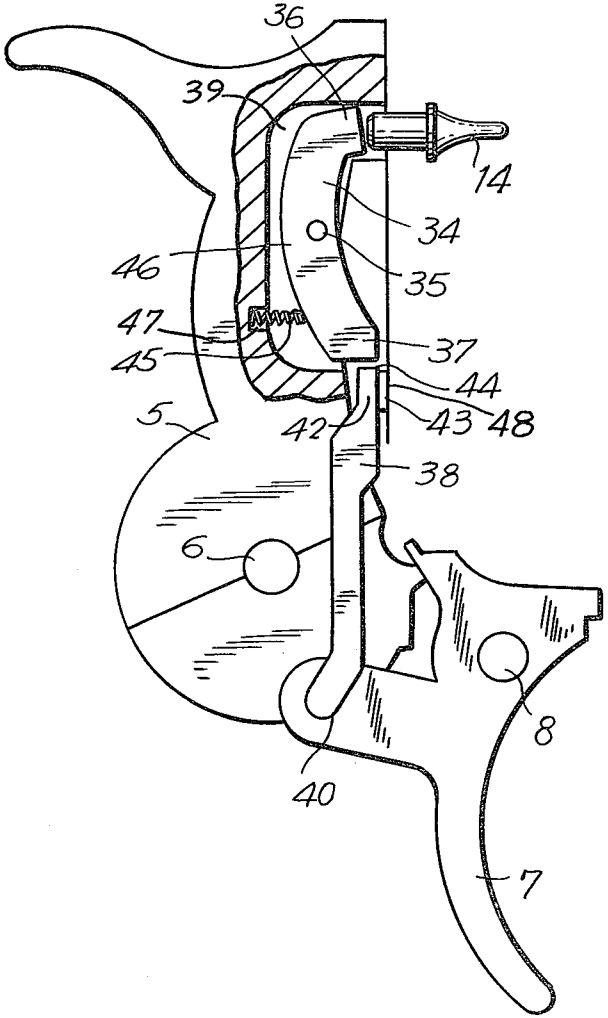
FIG. 6 is an alternative embodiment of this invention.

Referring to FIG. 6, there is shown an alternate embodiment of this invention. In particular, this embodiment is adapted for use with single action revolvers in which the hammer must be manually cocked prior to operating the trigger. The position of the hammer in the manually cocked mode is illustrated in FIG. 3, but FIG. 6 illustrates another embodiment of this invention with the trigger in the safe position for the single action firearm.

The anvil connector bar and trigger are similar to that described above, except that the anvil connector bar is extended at its upper end 42 to form an interfering surface 44 which bears against the bottom surface of anvil safety 34. In this position, the connector bar is being blocked from upward movement by the bottom of anvil safety 34 preventing the trigger from being movable. As may be appreciated from FIG. 3, when the hammer is in the manually cocked position, the anvil safety is moved from blocking the upper movement of connector bar 38, so that it may assume its upward position allowing the bottom of the anvil safety to hit the upper portion 42 of the connector bar when the firing action takes place.

Referring further to FIG. 6, there is shown an alternate embodiment for the anvil safety 34 of this invention. In particular, a spring 45 is connected to the rear surface 46 of the anvil safety 34 and into a hollow 47 formed in the hammer 5. The spring is biased so as to push the bottom 37 of anvil safety 34 forwardly, thus retracting the upper portion 36 of anvil safety 34 from its forward position.

What is claimed is:

1. In a firearm having a movable hammer, a cartridge receiving chamber located in front of the hammer when the hammer is in a strike mode, a firing pin associated with the hammer and mounted in position to strike and fire a cartridge in the chamber, a trigger pivotally mounted below said hammer to control the hammer movement, an improvement comprising a vertical slot formed in said hammer, said slot being located behind said firing pin to form a hollow behind said firing pin, a vertical anvil safety member located within said vertical slot pivotally connected to said hammer about a horizontal axis, the upper portion of said anvil safety member being located behind said firing pin and forming the striking surface of the hammer, said anvil safety member connected to said slot when the trigger is in its rest position such that said anvil safety member does not exert significant firing force on said firing pin, an anvil connector bar pivotally connected to said trigger and having an upper portion adapted to be positioned to impact the lower portion of said anvil safety member when said trigger moves toward its fire position, the force of impact between said anvil connector bar and the lower portion of said anvil safety member is transmitted to said upper portion of said anvil safety member by the upper portion moving forward to strike said firing pin.

2. The improved firing mechanism of claim 1 wherein said anvil safety member comprises a rearwardly bow shaped member.

3. The improved firing mechanism of claim 1, wherein said anvil safety member is connected in said slot to be freely rotatable when said trigger is in said rest position.

4. The improved firing mechanism of claim 3, wherein the upper portion of said anvil connector bar is located below the lower portion of said anvil safety member when said trigger is in said rest position, said anvil connector bar being moved upwardly when said trigger is moved to its fire position such that the upper portion of said anvil connector is moved into position to transmit the forward movement of said hammer through said anvil safety to said firing pin.

5. The improved firing mechanism of claim 4 wherein said anvil connector bar comprises an upper strike surface to be impacted by said anvil safety member as said hammer moves forward to fire, said anvil safety member striking said connector bar before said hammer completes its forward movement to provide an additional striking force on said firing pin due to the independent force formed between said anvil safety member and said connector bar before said hammer strikes the frame of the firearm.

6. The improved firing mechanism of claim 3 further comprising an anvil retaining pin pivotally connecting the center of said anvil safety member to said hammer.

7. The improved firing mechanism of claim 1, further comprising spring means connected between said hammer and said anvil safety member to maintain the upper portion of said anvil safety member away from said firing pin to ensure that said anvil safety member cannot strike said pin when said trigger is in the safe position.

8. The improved firing mechanism of claim 6, wherein said anvil safety member comprises a rearwardly bow shaped member.

9. The improved firing mechanism of claim 8, further comprising an anvil retaining pin pivotally connecting the center of said anvil safety member to said hammer.

10. The improved firing mechanism of claim 1, wherein the top of said anvil connector bar bears against the bottom of said anvil safety when said trigger is in said safe position to prevent said trigger from being moved.

11. The improved firing mechanism of claim 1 wherein the anvil safety member is so pivoted about said horizontal axis that the greater part of the mass of said anvil safety member is below said horizontal axis.

* * * * *